US005917367A

United States Patent [19]

Woo

[11] Patent Number: 5,917,367

[45] Date of Patent: Jun. 29, 1999

[54] POWER SUPPLY SOLUTION FOR MIXED SIGNAL CIRCUITS

[75] Inventor: Ann K. Woo, Cupertino, Calif.

[73] Assignee: Advanced Micro Devices, Inc., Sunnyvale, Calif.

[21] Appl. No.: 08/798,991

[22] Filed: Feb. 11, 1997

[51] Int. Cl.[6] ..... G05F 3/02

[52] U.S. Cl. ..... 327/537; 327/534; 327/536

[58] Field of Search ..... 327/534, 536, 327/537; 307/110

[56] References Cited

U.S. PATENT DOCUMENTS 5,689,209 11/1997 Williams et al. ..... 327/425

*Primary Examiner*—Terry D. Cunningham
*Attorney, Agent, or Firm*—Davis Chin

[57] ABSTRACT

There is provided an improved high-voltage generation circuit for use in a mixed signal circuit for multiplying an external power supply potential applied on its input to produce a higher output voltage at an output terminal. The high-voltage generation circuit is formed of a voltage multiplier circuit (114), a voltage comparator circuit (116), and switching circuitry (118). The voltage multiplier circuit is formed of a first stage (122) and at least one second stage (124) connected in series between the input terminal and the output terminal. The second stage is formed of a CMOS transistor (MP4) whose substrate is connected to a controlled node (N23). The voltage comparator circuit compares the external power supply potential and the output voltage and generates a control logic signal. The switching circuitry is responsive to the control logic signal for automatically connecting the controlled node to one of the external power supply potential and the output voltage so as to avoid forward-biasing of the substrate. As a result, there is achieved power savings and thus enhanced performance.

18 Claims, 3 Drawing Sheets

VOLTAGE MULTIPLIER 114
CLK
INV 4
INV 3
CK
CK
CKN
$V_{OUT}$
$C_{EXT}$
112
P32
N32
$V_{SS}$
INVERTER 2
N26
N24
Y'd
Y'c
MP4
124
INV 5
MP1
MN5
$V_{PS}$
N22
$C_{IN}$
Y'b
N21
P31
N31
$V_{SS}$
INVERTER 1
N25
$V_{AB}$
Y'a
MP2
122
110
$V_{PS}$
+
-

POWER SUPPLY SOLUTION FOR MIXED SIGNAL CIRCUITS

BACKGROUND OF THE INVENTION

1. Field of the Invention

This invention relates generally to CMOS voltage multiplier circuits and more particularly, it relates to an improved CMOS voltage multiplier for use in mixed signal circuits which includes means for sensing the highest potential node of an N-well process and for automatically connecting the local substrate thereof to the highest potential so as to avoid turning on the substrate.

2. Description of the Prior Art

As is generally well-known in the IC industry, there has been a trend of manufacturing semiconductor integrated circuit chips with a very high density so as to contain a larger and larger number of circuit components, such as VLSI chips. As a result, the problem of high power consumption for these integrated circuit chips has become a major concern. One of the ways in which the semiconductor IC manufacturers have used to solve this problem is to reduce the power supply voltage VCC (e.g., from +5.0 volts to +3.0 volts or lower). Nowadays, some of the integrated circuit chips fabricated in standard CMOS process technology have been designed to operate at a supply potential of +2.5 V or even below.

However, modern integrated circuit chips operable with a low power supply voltage are typically required to interface with previously developed CMOS semiconductor technologies operable with a higher power supply voltage. Further, in mixed signal circuits such as in a computer system some of the integrated circuit chips can function with only a low power supply voltage, but other integrated circuit chips require the higher power supply voltage. As used herein, the term "mixed signal circuits" refers to any circuit which contains both digital circuitry and analog circuitry. Therefore, while the newer digital circuitry may still be operable with the lower power supply voltage, there is imposed severe design limitations on the analog circuitry.

In order to overcome this drawback, there has been developed in the prior art of on-chip high-voltage generation circuitry which are capable of producing a relatively higher power supply voltage by multiplying a relatively low power supply voltage so as to provide more head room for the analog circuitry. One such method is illustrated in FIG. 1 and is labeled as "Prior Art," wherein a voltage multiplier circuit 2 is utilized in a VLSI mixed signal circuit 4 having digital circuitry 6 and analog circuitry 8. While the off-chip power supply voltage $V_{PS}$ is adequate to operate the digital circuitry 6, it is too low for driving the analog circuitry 8. Thus, the voltage multiplier circuit 2 serves to multiply the external power supply voltage $V_{PS}$ by n so as to provide a higher on-chip voltage $nV_{PS}$ for operating the analog circuitry 8. A multiplexer 7 has its inputs connected to the digital circuitry 6 for receiving a plurality of clocking signals CLK1, CLK2, . . . CLKn each being of a different frequency and generating selectively on its output one of the clocking signals defining a selected clock signal CLK. The selected clock signal CLK is used to regulate the charging rate of the voltage multiplier 2.

However, this use of the voltage multiplier 2 for generating a higher power supply voltage $nV_{PS}$ is not without any problems. In the past, the voltage multiplier 2 is formed of a plurality of CMOS transistors each being formed of either a PMOS or NMOS transistor connected in series between an input terminal and output terminal. Each of the PMOS or NMOS transistors is fabricated conventionally in a CMOS technology and includes a gate, source, drain, and a bulk region (N-well for P-channel devices). For the P-channel devices, the bulk region or local substrate is generally tied to the external power supply voltage $V_{PS}$. Further, the drain region of the PMOS transistor in the last stage is tied to the output terminal. Therefore, when the output voltage exceeds the external power supply voltage the p-n junction of the drain-substrate becomes forward biased or turned ON where unnecessarily wasted power occurs, thereby reducing the efficiency of the voltage multiplier.

It would therefore be desirable to provide an improved voltage multiplier for use in a mixed signal circuit which achieves power savings and thus enhanced performance. The high-voltage generation circuit of the present invention includes a voltage comparator circuit for comparing the external power supply voltage and the output voltage and for generating a control logic signal. Switching circuity is responsive to the control logic signal for automatically connecting the local substrate of the transistors in the voltage multiplier stages to one of the external power supply voltages and the output voltage so as to avoid turning on of the local substrate.

SUMMARY OF THE INVENTION

Accordingly, it is a general object of the present invention to provide an improved high-voltage generation circuit for use in a mixed signal circuit which overcomes the disadvantages of the prior art voltage multiplier circuits.

It is an object of the present invention to provide an improved high-voltage generation circuit for use in a mixed signal circuit which achieves power savings and thus enhanced performance.

It is another object of the present invention to provide an improved high-voltage generation circuit for use in a mixed signal circuit which includes means for sensing the highest potential node of an N-well process and for automatically connecting the local substrate thereof to the highest potential so as to avoid turning on the substrate.

It is still another object of the present invention to provide an improved high-voltage generation circuit for use in a mixed signal circuit which includes means for sensing the lowest potential node of a P-well process and for automatically connecting the local substrate thereof to the lowest potential so as to avoid turning on the substrate.

In a preferred embodiment of the present invention, there is provided a high-voltage generation circuit for use in a mixed signal circuit for multiplying an external power supply voltage applied on an input terminal to produce a higher output voltage at an output terminal. The high-voltage generation circuit includes a voltage multiplier formed of a first stage and a plurality of second stages connected in series between the input terminal and the output terminal. Each of the second stages is formed of a MOS transistor having a gate, source, drain, and local substrate whose drain-source conduction path of each second stage is connected in cascade. The local substrate of each second stage is connected to a controlled node.

A voltage comparator is used to compare the external power supply voltage and the output voltage and generates a control logic signal. Switching circuitry is responsive to the control logic signal for automatically connecting the controlled node to one of the external power supply voltages and the output voltage so as to avoid forward-biasing of the local substrate.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 2:
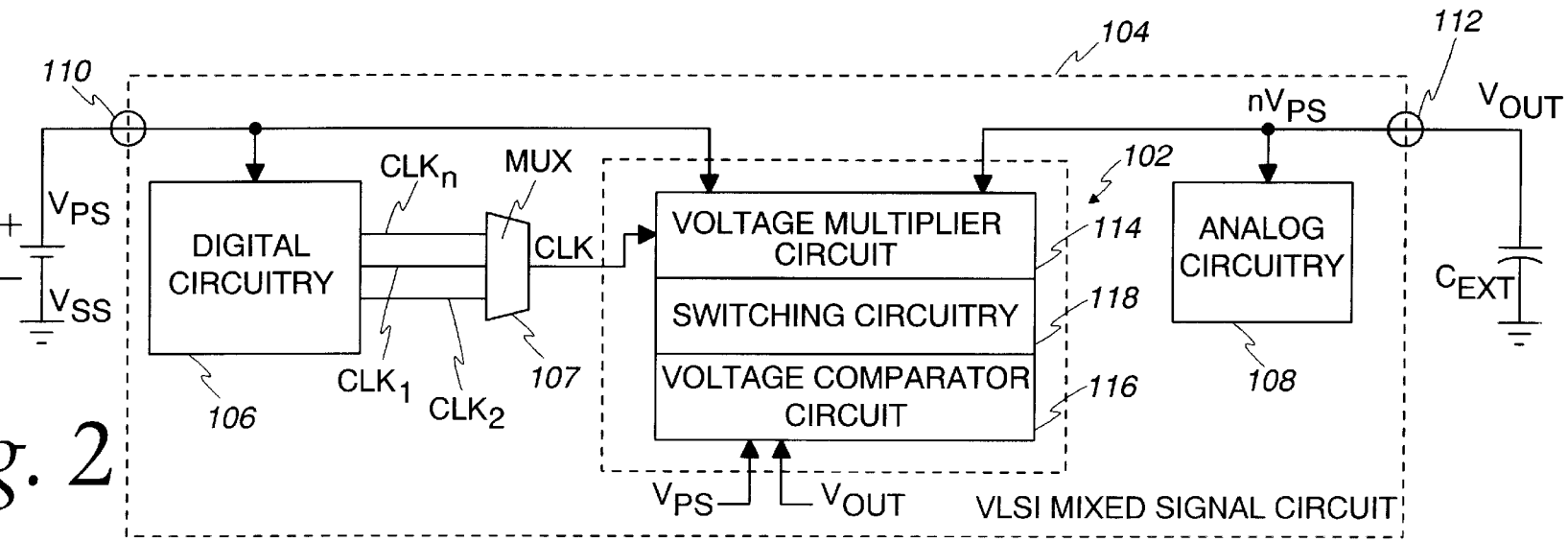
FIG. 2 is a block diagram of a VLSI mixed signal circuit employing a high-voltage generation circuit having a multiplier circuit, a voltage comparator, and switching circuitry, constructed in accordance with the principles of the present invention.

Referring now in detail to FIG. 2, there is shown in block diagram form a VLSI mixed signal circuit 104 which includes digital circuitry 106 and analog circuitry 108. An external (off-chip) power supply voltage $V_{PS}$ is supplied to an input terminal 110 for driving the digital circuitry 106. The mixed signal circuit 104 further includes an improved on-chip high-voltage generation circuit 102 constructed in accordance with the principles of the present invention for generating a higher power supply voltage $nV_{PS}$. This higher power supply voltage $nV_{PS}$ functions to drive the analog circuitry 108 and is connected to a large external (off-chip) capacitor $C_{ext}$ via an output terminal 112 defining an output voltage $V_{OUT}$. The high-voltage generation circuit 102 of the present invention is formed of a voltage multiplier circuit 114, a voltage comparator circuit 116, and switching circuitry 118. A multiplexer 107 has its inputs connected to the digital circuitry 106 for receiving a plurality of clocking signals CLK1, CLK2, . . . CLKn each being of a different frequency and generating selectively on its output one of the clocking signals defining a selected clock signal CLK. The selected clock signal CLK is used to regulate the charging rate of the voltage multiplier circuit 114.

In the high-voltage generation circuit 102, the voltage multiplier circuit 114 is to generate the higher power supply voltage $nV_{PS}$ defining the output voltage $v_{OUT}$, which is obtained by multiplying the external power supply voltage $V_{PS}$. The voltage comparator circuit 116 functions to compare the output voltage $V_{OUT}$ and the external power supply voltage $V_{PS}$ and to generate a control logic signal. The switching circuitry 118 is responsive to the control signal and automatically connects the local substrate (N-well of P-channel transistors) to the higher one of the input voltage and the output voltage in order to prevent forward-biasing or turning on of the drain-substrate junction which causes increased power consumption.

Figure 1:
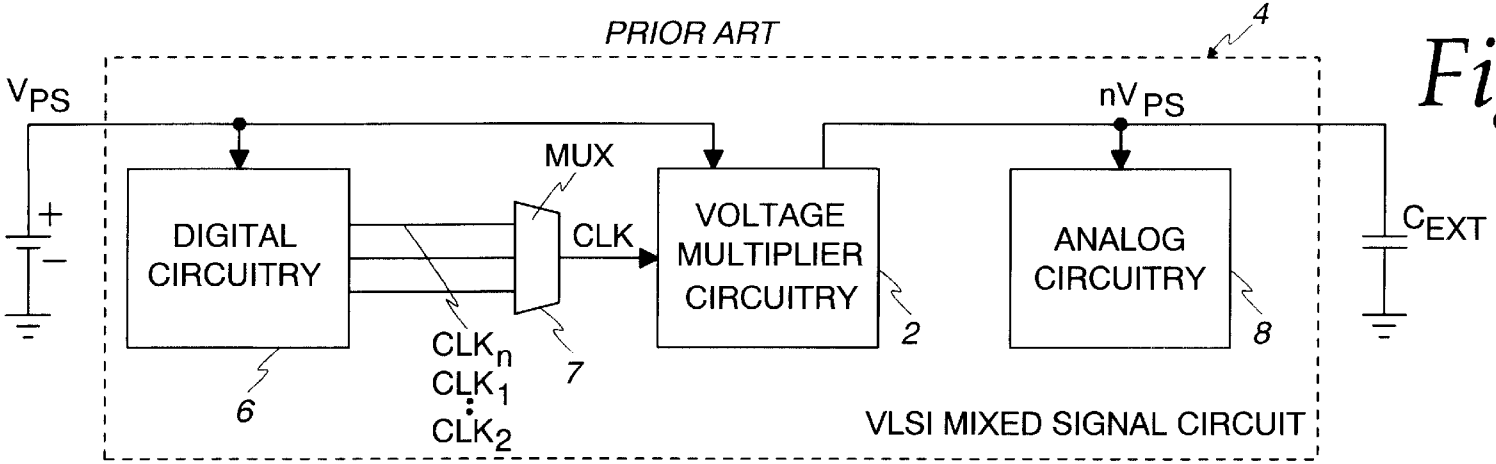
FIG. 1 is a block diagram of a VLSI mixed signal circuit employing a conventional multiplier.
Figure 3A:
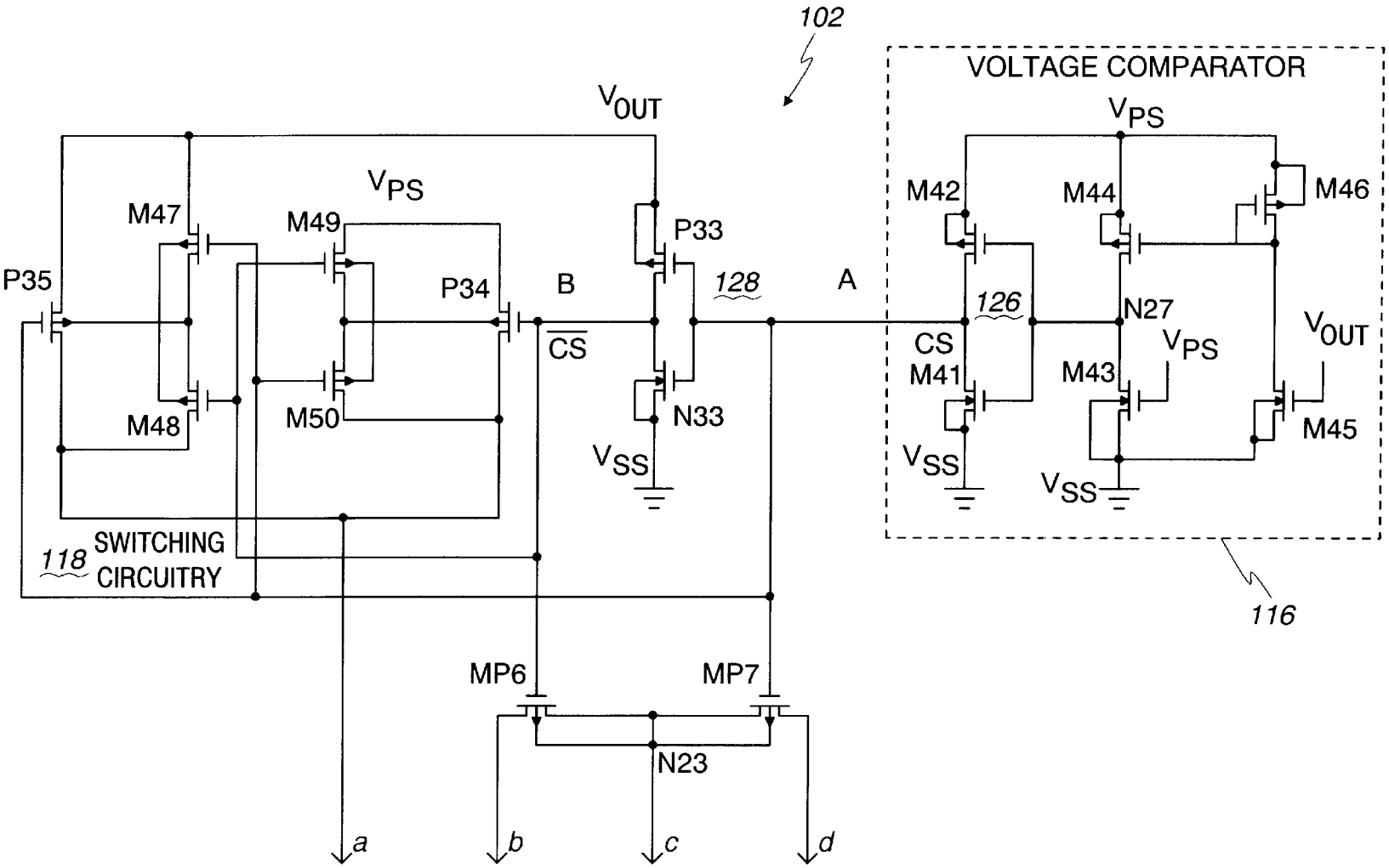
FIGS. 3*a* and 3*b*, when connected together, is a detailed schematic circuit diagram of the high-voltage generation circuit of FIG. 2.
Figures 3, 3A, 3B:
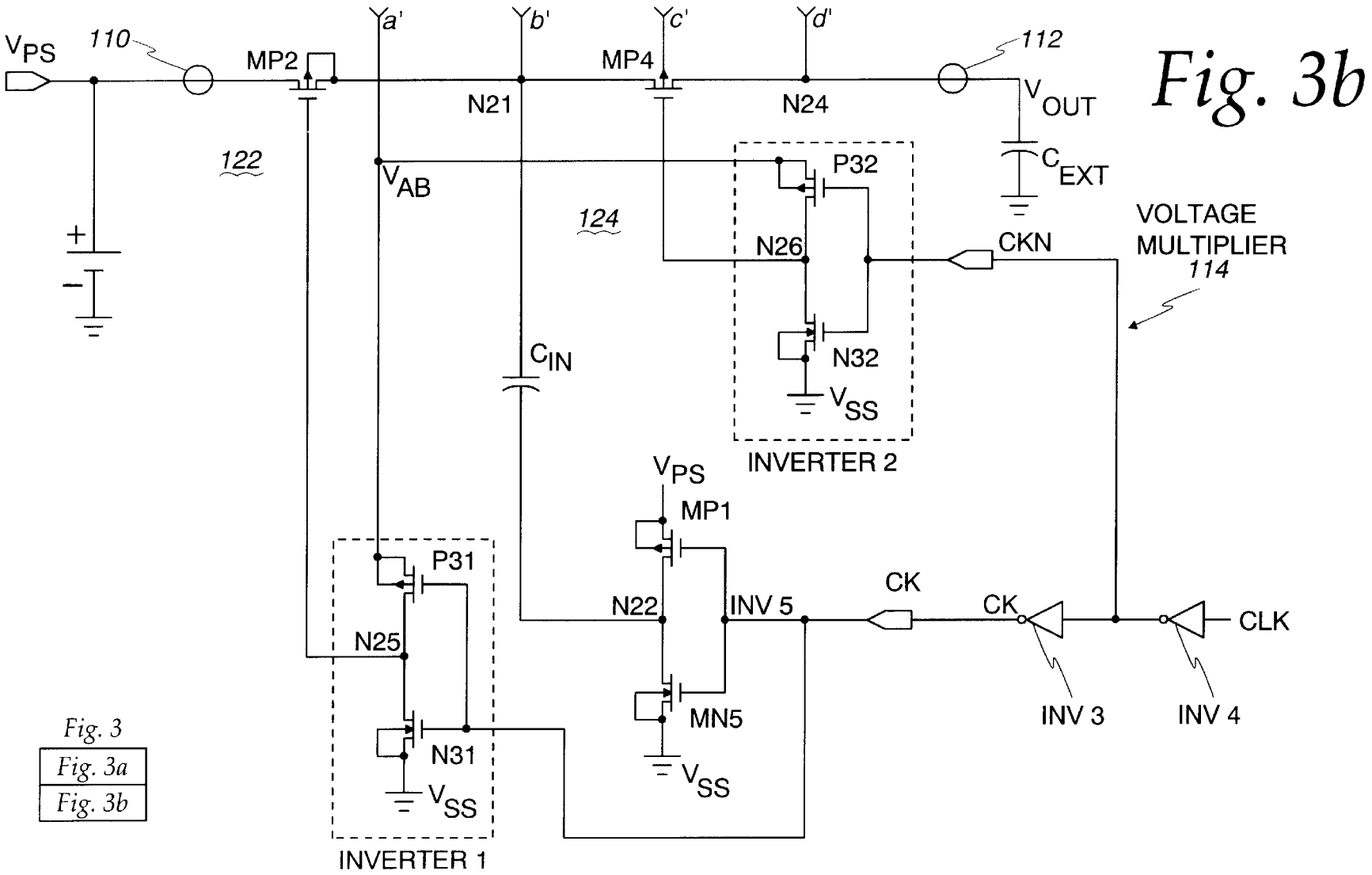

A detailed schematic circuit diagram of the on-chip high-voltage generation circuit 102 of FIG. 2 is illustrated in FIG. 3 of the drawings. The voltage multiplier circuit 114 includes a two-stage voltage multiplier formed of a first stage 122 and a second stage 124. For an N-well process, the first stage 122 is formed of a P-channel charge transfer transistor MP2 having its source region connected to the input terminal 110 for receiving the external power supply voltage $V_{PS}$, and its drain region connected to its local substrate (N-well) at intermediate node N21. The gate of the transistor MP2 is coupled to the clock signal CLK via inverters INV1, INV3, and INV4. The clock signal CLK is a squarewave generated by the output of the multiplexer 110 (FIG. 1). The clock signal CLKN is the complement of the clock signal CLK.

The second stage 124 is formed of a P-channel charge transistor MP4 having its source region connected to the internal node N21 and its drain region connected to the output terminal 112 via output node N24. The gate of the transistor MP4 is coupled to the clock signal CLK via inverters INV2 and INV4. The substrate of the transistor MP4 is connected to an internal controlled node N23. A coupling capacitor $C_{in}$ has its one end connected to the internal node N21 and its other end connected to the output of an inverter INV5. The input of the inverter INV5 is connected to the output of the inverter INV3. An external capacitor $C_{ext}$ has its one end connected to the output terminal 112 and its other end connected to a ground potential VSS. The capacitor $C_{in}$ is either an on-chip or off-chip capacitor having a small capacitance value on the order of picofarads. The capacitor $C_{ext}$ is a large external (off-chip) capacitor having a high capacitance value on the order of microfarads. While the two-stage voltage multiplier illustrated in FIG. 3 consists of a first stage 122 and a second stage 124, it should be clearly understood that the voltage multiplier circuit 114 employed in accordance with the present invention can be fabricated with any number of second stages as desired in order to provide the higher on-chip voltage $nV_{PS}$ for operating the analog circuitry.

The inverter INV1 is formed of a P-channel MOS transistor P31 and an N-channel MOS transistor N31. The gates of the transistors P31 and N31 are connected together defining the input of the inverter INV1, and the drains thereof are connected together defining its output. The input of the inverter INV1 is connected to the output of the inverter INV3, and the output of the inverter INV1 is connected to the gate of the charge transfer transistor MP2 via node N25. The input of the inverter INV3 is connected to the output of the inverter INV4 whose input is connected to receive the clock signal CLK. The transistor N31 has its substrate connected to its source and to the ground potential VSS. The transistor P31 has its substrate connected to its source and to a supply switching node $V_{ab}$.

Similarly, the inverter INV2 is formed of a P-channel MOS transistor P32 and an N-channel MOS transistor N32. The gates of the transistors P32 and N32 are connected together defining the input of the inverter INV2, and the drains thereof are connected together defining its output. The input of the inverter INV2 is connected to the output of the inverter INV4, and the output of the inverter INV2 is connected to the gate of the charge transfer transistor MP4 via node N26. The transistor N32 has its substrate connected to its source and to the ground potential VSS. The transistor P32 has its substrate connected to its source and also to the supply switching node $V_{ab}$. Further, the inverter INV5 is formed of a P-channel MOS transistor MP1 and an N-channel MOS transistor MN5 whose gates are connected together defining its input and whose drains are connected together defining its output. The input of the inverter INV5 is also connected to the output of the inverter INV3, and the output thereof of the inverter INV5 is connected to the capacitor $C_{in}$ at node N22. The transistor MN5 has its substrate connected to its source and to the ground potential. The transistor MP1 has its substrate connected to its source and to the external power supply potential $V_{PS}$.

It should be appreciated by those skilled in the art that the inverters INV3 and INV4 are conventional CMOS inverters. Thus, each of the inverters INV3 and INV4 is formed of a P-channel MOS transistor and an N-channel MOS transistor whose gates are connected together defining its input and whose drains are connected together defining its output.

The voltage comparator circuit 116 is comprised of a first input transistor M43, a second input transistor M45, a first load P-channel transistor M44, a second load P-channel transistor M46, and an inverter section 126. The inverter section 126 is formed of a P-channel MOS transistor M42 and an N-channel MOS transistor M41. The first input transistor M43 is an N-channel MOS transistor having its drain connected to the drain of the first load P-channel transistor M44, its source connected to its substrate and to the ground potential VSS, and its gate connected to receive the external power supply potential $V_{PS}$. The second input transistor M45 is an N-channel MOS transistor having its drain connected to the drain of the second load P-channel transistor M46, its source connected to its substrate and to the ground potential, and its gate connected to receive the output voltage $V_{OUT}$. The source and substrate of the first load transistor M44 are connected together and to the external power supply potential $V_{PS}$. The source and substrate of the second load transistor M46 are also connected together and to the external power supply potential $V_{PS}$. The gates of the load transistors M44 and M46 are connected together and to the drain of the second input transistor M45.

The gates of the inverter transistors M42 and M41 are connected together and to the common drains of the transistors M44 and M43 via node N27. The drains of the inverter transistors M42 and M41 are connected together and to a node A for providing a control logic signal CS. The transistor M41 has its substrate connected to its source and to the ground potential VSS, and the transistor M42 has its substrate connected to its source and to the external power supply potential $V_{PS}$.

The switching circuitry 118 includes a pair of first control P-channel transistors MP6 and a second control P-channel transistor MP7. The first control transistor MP6 has its source connected to the internal node N21, its drain connected to its substrate and its gate connected to a node B. The second control transistor MP7 has its source connected to the output node N24, its drain connected to its substrate, and its gate connected to the node A. It will be noted that the drains and substrates of the first and second control transistors MP6 and MP7 are all tied together at the controlled node N23, which is further tied to the substrate of the charge transfer transistor MP4.

The switching circuitry 118 further includes a first group of third, fourth and fifth control transistors P34, M48, and M49; a second group of sixth, seventh and eighth control transistors P35, M47, and M50; and an inverter portion 128 formed of a P-channel MOS transistor P33 and an N-channel MOS transistor N33. The gates of the inverter transistors P33 and N33 are connected together and to the node A defining its input, and the drains thereof are connected together and to the node B defining its output. The transistor N33 has its substrate connected to its source and to the ground potential VSS. The transistor P33 has its substrate connected to its source and to the output voltage $V_{OUT}$.

The output of the inverter portion 128 generates a complementary control logic signal $\overline{CS}$ and is connected to the gates of the third, fourth and fifth control transistors in the first group. The output of the inverter section 126 at the node A generating the control logic signal CS is connected to the gates of the sixth, seventh and eighth control transistors in the second group. The fifth control transistor M49 and the eighth control transistor M50 have their drains connected together. The source of the transistor M49 is connected to the external power supply potential $V_{PS}$, and the source of the transistor M50 is connected to the supply switching node $V_{ab}$. The conduction path (source/drain regions) of the third control transistor P34 is connected across the sources of the transistors M49 and M50. All of the substrates of the control transistors P34, M49 and M50 are connected together.

Similarly, the seventh control transistor M47 and the fourth control transistor M48 have their drains connected together. The source of the transistor M47 is connected to the output voltage $V_{OUT}$, and the source of the transistor M48 is connected to the supply switching node $V_{ab}$. The conduction path (source/drain regions) of the sixth control transistor P35 are connected across the sources of the transistors M47 and M48. All of the substrates of the control transistors P35, M47, and M48 are connected together.

The operation of the improved high-voltage generation circuit 102 of the present invention for use in the VLSI mixed signal circuit 104 of FIG. 2 will now be explained in detail with reference to FIG. 3. Initially, it is assumed that the external capacitor $C_{ext}$ is uncharged or is at 0 volts. As previously pointed out, the selected clock pulse CLK from the multiplexer 107 is used to generate the complementary pulse signals CK and CKN at the outputs of the respective inverters INV3 and INV4. The charge transfer transistors MP2 and MP4 are turned ON and OFF by the corresponding inverters INV1 and INV2 via the respective complementary signals CK and CKN. When the selected clock signal CLK is at a high or "1" logic level, the transistors N31, N22, and P32 in the corresponding inverters INV1, INV5, and INV2 will be turned ON and the transistors P31, MP1, and N32 will be turned OFF. As a result, the charge transfer transistor MP2 in the first stage will be turned ON and the charge transfer transistor MP4 in the second stage will be turned OFF. Thus, the coupling capacitor $C_{in}$ will be charging up to the external power supply potential $V_{PS}$ via the transistor MP2.

On the other hand, when the clock signal CLK is at a low or "0" logic level, the inverter transistors P31, MP1, and N32 in the corresponding inverters INV1, INV5, and INV2 will be turned ON, and the inverter transistors N31, N22, and P32 will be turned OFF. Consequently, the charge transfer transistor MP4 will be turned ON, and the charge transfer transistor MP2 will be turned OFF. Therefore, the voltage at the internal node N21 will be equal to the voltage across the capacitor $C_{in}$ in series with the external power supply potential $V_{PS}$ via the inverter transistor MP1. With the charge transfer transistor MP4 being turned ON, the external capacitor $C_{ext}$ will be charging up to the output voltage $V_{OUT}$ at the output node N24 or output terminal 112.

In a conventional voltage multiplier circuit, the substrate (which is the P-well region in which the MOS transistor is fabricated) is tied to the external power supply potential $V_{PS}$. Since the drain region of the charge transfer transistor MP4 is connected to the output voltage $V_{OUT}$ at the node N24, as the voltage on the external capacitor $C_{ext}$ is charged to a voltage higher than the external power supply potential or input voltage $V_{PS}$ then the p-n junction (drain-substrate) will be activated or forward biased causing wasted power dissipation and reducing the efficiency of the voltage multiplier circuit. In order to overcome this problem, the substrate (N-well region) of the charge transfer transistor MP4 in the present voltage multiplier circuit 114 is connected to the controlled node N23 which is automatically connected to the highest potential so as to prevent turning on of the p-n junction.

When the high-voltage generation circuit 102 is initially turned ON, the output voltage ($V_{OUT}$=0) will be less than the input supply voltage $V_{PS}$. As can be seen, these two voltages are compared by the voltage comparator circuit 116 so as to render the first input transistor M43 conductive and the second input transistor M45 non-conductive. Thus, the node N27 will be low and the control logic signal at the node A will be at the high level due to the inverter section 126.

Further, the node B will be at the low level due to the inverter portion 128. As a result, the first control transistor MP6 in the switching circuitry 118 will be turned ON, and the second control transistor MP7 will be turned OFF. With the transistor MP6 conducting, the substrate of the charge transfer transistor MP4 in the second stage 124 will be tied to the internal node N21 which is, in turn, being charged to the external voltage power supply potential $V_{PS}$ via the coupling capacitor $C_{in}$.

At the same time, the low voltage at the node B will cause the first group of control transistors P34, M48, and M49 in the switching circuitry 118 to be turned ON and the high level at the node A will cause the second group of control transistors P35, M47 and M50 to be turned OFF. Consequently, the switching supply node $V_{ab}$ will be connected to the external power supply potential or input voltage $V_{PS}$ via the transistor P34. Thus, the sources of the inverter transistors P31 and P32 in the respective inverters INV1 and INV2 will also be powered by the external power supply potential $V_{PS}$.

However, as the output voltage $V_{OUT}$ on the external capacitor $C_{ext}$ becomes charged to a voltage higher than the input voltage $V_{PS}$, this will be sensed by the voltage comparator circuit 116 so as to render the second input transistor M45 conductive and the first input transistor M43 non-conductive. Therefore, the node N27 will now be at a high level, the control logic signal CS at the node A will be at the low level, and the node B will be at the high level. This causes the second control transistor MP7 to be turned ON and the first control transistor MP6 to be turned OFF. With the transistor MP7 conducting, the substrate of the charge transfer transistor MP4 in the second stage 124 will now be tied to the output node N24 which is, in turn, connected to the output voltage $V_{OUT}$ across the external capacitor $C_{ext}$.

Simultaneously, the low level at the node A will cause the second group of control transistors P35, M47, and M50 in the switching circuitry 118 to be turned ON, and the high level at the node B will cause the first group of control transistors P34, M48, and M49 to be turned OFF. Consequently, the switching supply node $V_{ab}$ will now be connected to the output voltage $V_{OUT}$ via the transistor P35. Thus, the sources of the inverter transistors P31 and P32 in the respective inverters INV1 and INV2 will also be powered by the output voltage $V_{OUT}$.

In this manner, the substrate or N-well region of the P-channel transistor MP4 in the second stage 124 of the voltage multiplier circuit 114 is always connected to the highest potential so as to avoid turning on the p-n junction. In other words, the N-well is biased at the external power supply potential or input voltage $V_{PS}$ when the output voltage $V_{OUT}$ is less than the input voltage $V_{PS}$ (during the initial charging of the external capacitor $C_{ext}$) and will be biased at the output voltage $V_{OUT}$ when the output voltage $V_{OUT}$ is higher than the input voltage $V_{PS}$. It should be appreciated by those skilled in the art that the principles of the present invention can be equally applied when the voltage multiplier circuit is fabricated as N-channel transistors in a P-well process. In this latter case, the voltage comparator circuit 116 will be modified to sense the lowest on-chip potential, and the switching circuitry 118 will automatically connect the P-well region of the N-channel transistor to the lowest potential.

From the foregoing detailed description, it can thus be seen that the present invention provides an improved high-voltage generation circuit for use in a mixed signal circuit for multiplying an external power supply potential applied on an input terminal to produce a higher output voltage at an output terminal. The high-voltage generation circuit of the present invention provides for power savings and thus enhanced performance in its operation. This is achieved by a voltage comparator circuit for sensing the highest potential node of an N-well process or the lowest potential node of a P-well process and for generating a control logic signal. A switching circuitry is responsive to the control logic signal for automatically connecting the substrate of the charge transfer transistor in the voltage multiplier circuit to the highest potential (lowest potential) so as to avoid turning on the substrate.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

I claim:

1. A high-voltage generation circuit for multiplying an external power supply potential applied on an input terminal to produce a higher output voltage at an output terminal comprising:

voltage multiplier means formed of a first stage and a plurality of second stages connected in series between the input terminal and the output terminal, each of said plurality of second stages being formed of a MOS transistor having a gate source and drain and local substrate, the drain-source conduction path of each of said plurality of second stages being connected in cascade, the local substrate of each said plurality of second stages being connected to a controlled node;

voltage comparator means for comparing said external power supply potential and said output voltage and for generating a control logic signal; and switching circuit means responsive to said control logic signal for automatically coupling said controlled node to one of an output of the first stage of and said output voltage on the output terminal so as to avoid forward-biasing of said local substrate.

2. A high-voltage generation circuit as claimed in claim 1, wherein said MOS transistors of said plurality of second stages are P-channel MOS transistors whose source and drain are formed in corresponding N-well regions, each defining the local substrate.

3. A high-voltage generation circuit as claimed in claim 2, wherein said control logic signal from said voltage comparator means is at a high logic level when said external power supply potential is greater than said output voltage and is at a low logic level when said output voltage is greater than said external power supply potential.

4. A high-voltage generation circuit as claimed in claim 3, wherein said switching circuit means couples said controlled node to said external power supply potential when said control signal is at the high logic level and couples said controlled node to said output voltage when said control signal is at the low logic level.

5. A high-voltage generation circuit as claimed in claim 2, wherein said switching circuit means automatically couples said N-well regions to the higher of said external power supply potential and said output voltage so as to prevent the turning on of said substrate.

6. A high-voltage generation circuit as claimed in claim 4, wherein said voltage comparator means is comprised of a first input transistor having its gate connected to receive said external power supply potential, a second input transistor having its gate connected to receive said output voltage, a first load transistor coupled to said first input transistor, a second load transistor coupled to said second input transistor, and an inverter section formed of a P-channel transistor and an N-channel transistor, said inverter section having an output for providing said control logic signal.

7. A high-voltage generation circuit as claimed in claim 6, wherein said switching circuit means is comprised of first and second control transistors, said drains and substrates of said first and second control transistors being connected together and to said controlled node, said source of said first control transistor being connected to the source of said P-channel MOS transistor in a first stage of said plurality of second stages, said source of said second control transistor being connected to the drain of said P-channel MOS transistor in a last stage of said plurality of second stages, said gate of said second control transistor being connected to receive said control logic signal and said gate of said first control transistor being connected to receive a complement of said control logic signal.

8. A high-voltage generation circuit as claimed in claim 7, wherein said plurality of second stages further includes an inverter having its output connected to said gates of said P-channel MOS transistors in alternate ones of said plurality of second stages.

9. A high-voltage generation circuit as claimed in claim 8, wherein said inverter is formed of a P-channel transistor and an N-channel transistor, said source of said P-channel transistor being connected to a supply switching node.

10. A high-voltage generation circuit as claimed in claim 9, wherein said switching circuit means further includes means for switching said supply switching node between said external power supply potential and said output voltage.

11. A high-voltage generation circuit for multiplying an external power supply potential applied on an input terminal to produce a higher output voltage at an output terminal comprising:

voltage multiplier means including a first stage and at least one second stage connected in series between the input terminal and the output terminal, said at least one second stage being formed of a P-channel MOS transistor whose source and drain are connected between said first stage and the output terminal, the substrate of said P-channel MOS transistor being connected to a controlled node;

voltage comparator means for comparing said external power supply potential and said output voltage and for generating a control logic signal; and switching circuit means responsive to said control logic signal for automatically coupling said substrate of said P-channel MOS transistor in said at least one second stage to the higher of an output of the first stage applied on the input terminal and said output voltage on the output terminal so as to prevent the turning on of said substrate.

12. A high-voltage generation circuit as claimed in claim 11, wherein said voltage comparator means is comprised of a first input transistor having its gate connected to receive said external power supply potential, a second input transistor having its gate connected to receive said output voltage, a first load transistor coupled to said first input transistor, a second load transistor coupled to said second input transistor, and an inverter section formed of a P-channel transistor and an N-channel transistor, said inverter section having an output for providing said control logic signal.

13. A high-voltage generation circuit as claimed in claim 12, wherein said switching circuit means is comprised of first and second control transistors, said drains and substrates of said first and second control transistors being connected together and to said controlled node, said source of said first control transistor being connected to the source of said P-channel MOS transistor in said at least one second stage, said source of said second control transistor being connected to the drain of said P-channel MOS transistor in said at least one second stage, said gate of said second control transistor being connected to receive said control logic signal and said gate of said first control transistor being connected to receive a complement of said control logic signal.

14. A high-voltage generation circuit as claimed in claim 13, wherein said at least one second stare further includes an inverter having its output connected to said gate of said P-channel MOS transistor in said at least one second stage.

15. A high-voltage generation circuit as claimed in claim 14, wherein said inverter is formed of a P-channel transistor and an N-channel transistor, said source of said P-channel transistor being connected to a supply switching node.

16. A high-voltage generation circuit as claimed in claim 15, wherein said switching circuit means further includes means for switching said supply switching node between said external power supply potential and said output voltage.

17. A high-voltage generation circuit having an input terminal and an output terminal comprising:

voltage multiplier means formed of a first stage and at least one second stage connected in series between the input terminal and the output terminal, said at least one second stage being formed of a MOS transistor having a gate, source, drain, and local substrate, the drain-source conduction path of each of said at least one second stage being connected in cascade, the local substrate of said at least one second stage being connected to a controlled node;

voltage comparator means for comparing an external power supply potential applied to the input terminal and an output voltage on the output terminal and for generating a control logic signal; and switching circuit means responsive to said control logic signal for automatically coupling said substrate of said MOS transistor in said at least one second stage to one of said external power supply potential and said output voltage so as to prevent the turning on of said substrate.

18. A high-voltage generation circuit as claimed in claim 17, wherein said MOS transistor is a P-channel transistor and said switching circuit means automatically couples said substrate of said P-channel transistor to he higher of said external power supply potential and said output voltage so as to prevent the turning on of said substrate.

* * * * *

UNITED STATES PATENT AND TRADEMARK OFFICE

CERTIFICATE OF CORRECTION

PATENT NO : 5,917,367

DATED : June 29, 1999

INVENTOR(S) : Ann K. Woo

It is certified that error appears in the above-identified patent and that said Letters Patent is hereby corrected as shown below:

Column 8, line 46, cancel "of" (third occurrence);

Column 10, line 26, change "stare" to --stage--;

Column 10, line 56, change "said external power supply potential" to --an output of the first stage--.

Signed and Sealed this

Ninth Day of November, 1999

*Attest:*

Q. TODD DICKINSON

*Attesting Officer*

*Acting Commissioner of Patents and Trademarks*